US010325555B2

(12) United States Patent
Wu et al.

(10) Patent No.: US 10,325,555 B2
(45) Date of Patent: Jun. 18, 2019

(54) ORGANIC LIGHT EMITTING PIXEL COMPENSATION CIRCUIT, ORGANIC LIGHT EMITTING DISPLAY PANEL, AND METHOD FOR DRIVING THE PANEL

(71) Applicants: Shanghai Tianma AM-OLED Co., Ltd., Shanghai (CN); Tianma Micro-Electronics Co., Ltd., Shenzhen (CN)

(72) Inventors: Tong Wu, Shanghai (CN); Yue Li, Shanghai (CN); Dongxu Xiang, Shanghai (CN); Gang Liu, Shenzhen (CN)

(73) Assignees: SHANGHAI TIANMA AM-OLED CO., LTD., Shanghai, P.R. (CN); TIANMA MICRO-ELECTORNICS CO., LTD., Shenzhen, P.R. (CN)

( * ) Notice: Subject to any disclaimer, the term of this patent is extended or adjusted under 35 U.S.C. 154(b) by 106 days.

(21) Appl. No.: 15/473,490

(22) Filed: Mar. 29, 2017

(65) Prior Publication Data

US 2017/0206839 A1 Jul. 20, 2017

(30) Foreign Application Priority Data

Dec. 9, 2016 (CN) ..... 2016 1 1126639

(51) Int. Cl.
*G09G 3/3233* (2016.01)

(52) U.S. Cl.
CPC ..... *G09G 3/3233* (2013.01); *G09G 2300/043* (2013.01); *G09G 2300/0819* (2013.01);
(Continued)

(58) Field of Classification Search
None
See application file for complete search history.

(56) References Cited

U.S. PATENT DOCUMENTS 7,982,695 B2 * 7/2011 Mizukoshi ..... G09G 3/3233 345/690
9,520,087 B2 * 12/2016 Park ..... G09G 3/3233
2008/0169460 A1 * 7/2008 Yoo ..... G09G 3/3233 257/40

(Continued)

FOREIGN PATENT DOCUMENTS

CN 101615379 A 12/2009

OTHER PUBLICATIONS

Chinese, 1st Office Action dated May 29, 2018.

*Primary Examiner* — Lunyi Lao
*Assistant Examiner* — Benjamin X Casarez
(74) *Attorney, Agent, or Firm* — Alston & Bird LLP

(57) ABSTRACT

An organic light emitting pixel compensation circuit, an organic light emitting display panel, and a driving method are provided. The organic light emitting pixel compensation circuit includes an external compensation module, which has a data line, a reference voltage line, a reset control line, a first detection control line, a second detection control line, a first input/output terminal, a second input/output terminal, a reset unit, a threshold voltage detection unit, a deterioration voltage detection unit, a data processing unit, and an adder unit. The deterioration compensation for a light emitting element is achieved by detecting and processing an anode voltage at the second input/output terminal to obtain a compensated voltage, and feeding the compensated data voltage back to a gate of a driving transistor via the data line.

27 Claims, 12 Drawing Sheets

(52) U.S. Cl.
CPC ..... *G09G 2300/0842* (2013.01); *G09G 2300/0861* (2013.01); *G09G 2320/0233* (2013.01); *G09G 2320/043* (2013.01); *G09G 2320/045* (2013.01)

(56) References Cited

U.S. PATENT DOCUMENTS

2008/0231562 A1* 9/2008 Kwon ..... G09G 3/3233 345/77
2009/0027377 A1* 1/2009 Kwon ..... G09G 3/3233 345/214
2009/0051628 A1* 2/2009 Kwon ..... G09G 3/3233 345/77
2009/0213046 A1* 8/2009 Nam ..... G09G 3/3233 345/76
2009/0309818 A1* 12/2009 Kim ..... G09G 3/3233 345/77
2010/0073335 A1* 3/2010 Min ..... G09G 3/3233 345/204
2011/0227505 A1* 9/2011 Park ..... H05B 33/0896 315/297
2013/0050292 A1* 2/2013 Mizukoshi ..... G09G 3/3291 345/690
2013/0127692 A1* 5/2013 Yoon ..... G09G 3/3258 345/80
2015/0179105 A1* 6/2015 Mizukoshi ..... G09G 3/3266 345/76
2015/0379940 A1* 12/2015 Kishi ..... G09G 3/3225 345/690
2016/0098960 A1* 4/2016 Park ..... G09G 3/3233 345/205
2016/0189623 A1* 6/2016 Miwa ..... G09G 3/3258 345/212
2017/0046006 A1* 2/2017 Kim ..... G02F 1/13338
2017/0249899 A1* 8/2017 Xiang ..... G09G 3/3233
2018/0144689 A1* 5/2018 Hong ..... G09G 3/3233

* cited by examiner

ORGANIC LIGHT EMITTING PIXEL COMPENSATION CIRCUIT, ORGANIC LIGHT EMITTING DISPLAY PANEL, AND METHOD FOR DRIVING THE PANEL

CROSS-REFERENCE TO RELATED APPLICATION

This application is related to and claims priority from Chinese Patent Application No. 201611126639.X, filed on Dec. 9, 2016, entitled "Organic Light Emitting Pixel Compensation Circuit, Organic Light Emitting Display Panel, and Method for Driving the Panel," the entire disclosure of which is hereby incorporated by reference for all purposes.

TECHNICAL FIELD

The present application relates to the field of display technology, and particularly to an organic light emitting pixel compensation circuit, an organic light emitting display panel, and a driving method.

BACKGROUND

With the development of display technologies, liquid crystal displays (LCDs) and organic light emitting diode (OLED) displays, as two types of popular display devices, are more widely used in various portable electronic devices.

LCD is a non-self-luminous device, and OLED is an organic self-luminous device. Compared with the LCD, the OLED display has faster response speed, higher contrast and wider viewing angle, so the OLED display receives more attention.

However, in a conventional OLED display, generally only the threshold voltage of a driving transistor of the light emitting diode is compensated, without considering the impact from the deterioration of the light emitting element. For example, as time passes, the forward voltage drops across the light-emitting element (the lowest forward voltage at which the light-emitting element can be turned on at a prescribed forward current) is increased when the current flows through the light-emitting element. The light-emitting element is usually connected to a source and a drain of the driving transistor. As a result, the potential difference between the source and drain of the driving transistor decreases. Therefore, the light-emitting current flowing through the light-emitting element also decreases, resulting in display anomalies.

In view of the defects or disadvantages existing in the conventional OLED drivers, it is desirable to provide an organic light emitting pixel compensation circuit, an organic light emitting display panel, and a driving method, to solve the existing technical problems.

SUMMARY

According to an aspect of the present application, an organic light emitting pixel compensation circuit is provided, which includes an external compensation module comprising a data line, a reference voltage line, a reset control line, a first detection control line, a second detection control line, a first input/output terminal, a second input/output terminal, a reset unit, a threshold voltage detection unit, a deterioration voltage detection unit, a data processing unit, and an adder unit. The reset unit is connected to the reference voltage line, the second input/output terminal, and configured to transmit a signal provided from the reference voltage line to the second input/output terminal, based on a signal from the reset control line. The threshold voltage detection unit is connected to the data line, the first input/output terminal, and the data processing unit, and configured to transmit a voltage on the first input/output terminal to the data processing unit, based on a signal from the first detection control line. The deterioration voltage detection unit is connected to the second input/output terminal and the data processing unit, and configured to transmit a voltage on the second input/output terminal to the data processing unit, based on a signal from the second detection control line. The data processing unit is connected to the threshold voltage detection unit, the deterioration voltage detection unit, and the adder unit, and configured to process the voltages provided from the threshold voltage detection unit and the deterioration voltage detection unit, and transmit the processed voltages to the adder unit. The adder unit is connected to the data processing unit and the data line, and configured to provide a compensated voltage, based on the voltage provided from the data processing unit and the voltage on the data line.

According to another aspect of the present application, an organic light emitting display panel is also provided, which includes a display region and a non-display region surrounding the display region. A plurality of external compensation modules is arranged in the non-display region. Each of the external compensation modules includes a data line, a reference voltage line, a reset control line, a first detection control line, a second detection control line, a first input/output terminal, a second input/output terminal, a reset unit, a threshold voltage detection unit, a deterioration voltage detection unit, a data processing unit, and an adder unit. The reset unit is connected to the reference voltage line and the second input/output terminal, and configured to transmit a signal provided from the reference voltage line to the second input/output terminal, based on a signal from the reset control line. The threshold voltage detection unit is connected to the data line, the first input/output terminal, and the data processing unit, and configured to transmit a voltage on the first input/output terminal to the data processing unit, based on a signal from the first detection control line. The deterioration voltage detection unit is connected to the second input/output terminal and the data processing unit, and configured to transmit a voltage on the second input/output terminal to the data processing unit, based on a signal from the second detection control line. The data processing unit is connected to the threshold voltage detection unit, the deterioration voltage detection unit, and the adder unit, and configured to process the voltages provided from the threshold voltage detection unit and the deterioration voltage detection unit, and transmit the processed voltages to the adder unit. The adder unit is connected to the data processing unit and the data line, and configured to provide a compensated voltage, based on the voltage provided from the data processing unit and the voltage on the data line.

According to another aspect of the present application, a method for driving an organic light emitting display panel is further provided. The method includes the following. During initialization, a data line provides a data voltage, a reference voltage line provides a reference voltage, a first source voltage terminal provides a first voltage, a data voltage write unit transmits the data voltage to a gate of a driving transistor based on a signal from a first scan line, a reset detection control unit is turned on based on a signal from a second scan line, a reset unit transmits the reference voltage to an anode of a light emitting element based on a signal from a reset control line, and a light emission control unit transmits the first voltage to a first electrode of the driving transistor based on a signal from a light emission control line. During detection of a threshold voltage, the light emission control unit is turned off based on a signal from the light emission control line, the voltage on the first electrode of the driving transistor is transmitted via a first input/output terminal to a threshold voltage detection unit, and the threshold voltage detection unit implements the detection on the driving transistor based on a signal from the first detection control line. During writing of the first voltage, the threshold voltage detection unit is turned off based on a signal from the first detection control line, the reset unit is turned off based on a signal from the reset control line, a data processing unit processes the detected voltage to obtain a threshold voltage, an adder unit performs compensation on the data voltage based on the threshold voltage, and the data voltage write unit transmits the compensated data voltage to the gate of the driving transistor based on a signal from the first scan line. During detection of a deterioration voltage, the light emission control unit is turned on based on a signal from the light emission control line, an anode voltage of the light emitting element is transmitted to a second input/output terminal, and a deterioration voltage detection unit implements the detection on the light emitting element based on a signal from a second detection control line. During writing of a second voltage, the light emission control unit is turned off based on a signal from the light emission control line, the deterioration voltage detection unit is turned off based on a signal from the second detection control line, the data processing unit processes the detected anode voltage to obtain a deterioration voltage, the adder unit performs compensation on the data voltage based on the deterioration voltage, and the data voltage write unit transmits the compensated data voltage to the gate of the driving transistor based on a signal from the first scan line. During light emission, the data voltage write unit is turned off based on a signal from the first scan line, the reset detection control unit is turned off based on a signal from the second scan line, the light emission control unit is turned on based on a signal from the light emission control line, and the light emitting element emits light.

According to the solutions provided in the present application, the anode voltage of the second input/output terminal is detected and processed to produce a compensated voltage, and the compensated voltage is fed via the data line back to the gate of the driving transistor, thereby achieving the deterioration compensation for the light emitting element.

BRIEF DESCRIPTION OF THE DRAWINGS

Other features, objects, and advantages of the present application will become more apparent upon reading of the following detailed description of the non-limiting embodiments with reference to the accompanying drawings.

DETAILED DESCRIPTION OF EMBODIMENTS

The present application will be further described below in detail in combination with the accompanying drawings and the embodiments. It should be appreciated that the specific embodiments described herein are merely used for explaining the relevant invention, rather than limiting the invention. In addition, it should be noted that, for the ease of description, only the parts related to the relevant invention are shown in the accompanying drawings.

It should also be noted that the embodiments in the present application and the features in the embodiments may be combined with each other on a non-conflict basis. The present application will be described below in detail with reference to the accompanying drawings and in combination with the embodiments.

Figure 1A:
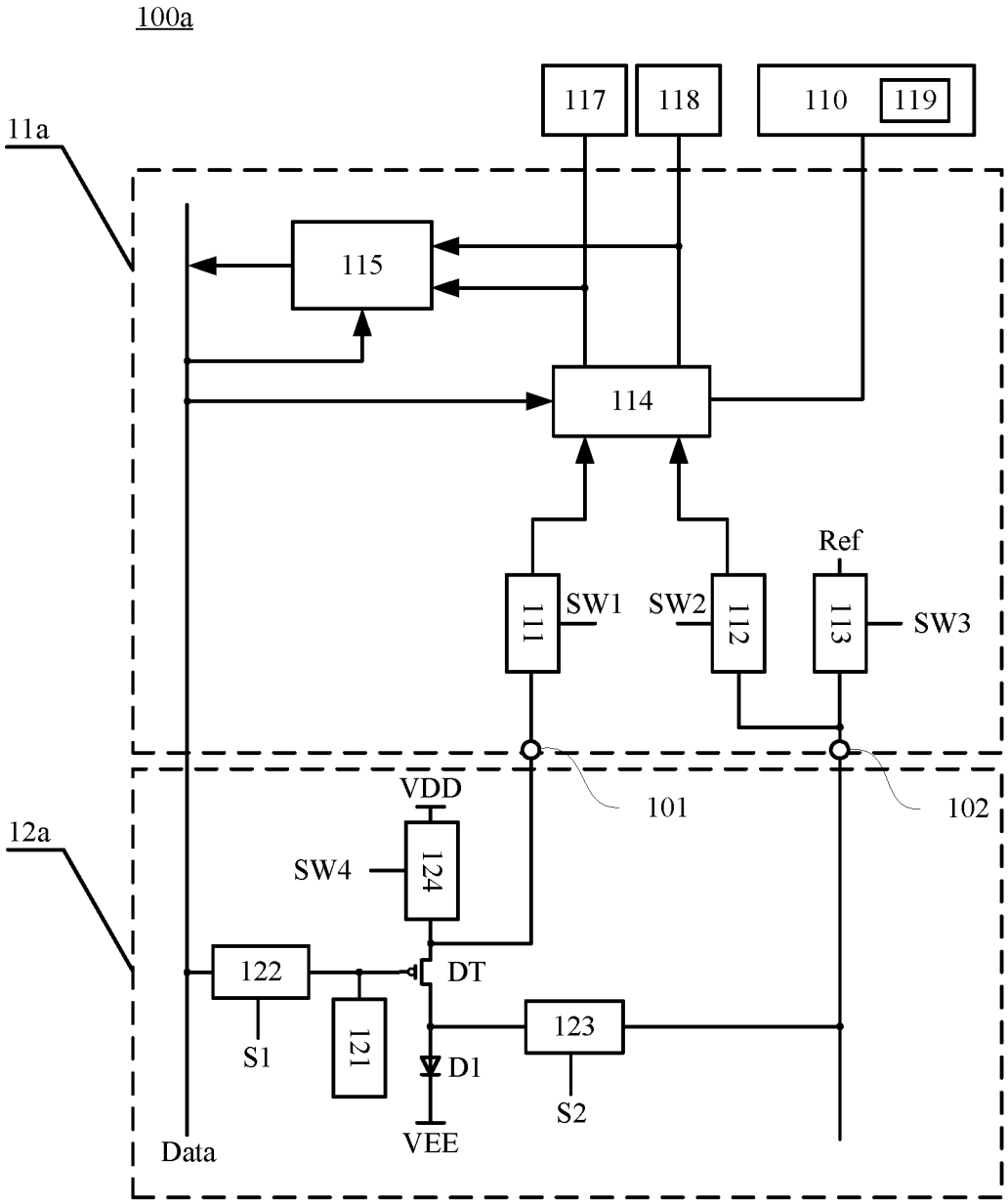
FIG. 1A shows a schematic diagram of an embodiment of an organic light emitting pixel compensation circuit according to the present application.

FIG. 1A shows a schematic diagram of an embodiment of an organic light emitting pixel compensation circuit according to the present application.

As shown in FIG. 1A, an organic light emitting pixel compensation circuit 100*a* may include an external compensation module 11*a*, and the external compensation module 11*a* includes a data line Data, a reference voltage line Ref, a reset control line SW3, a first detection control line SW1, a second detection control line SW2, a first input/output terminal 101, a second input/output terminal 102, a reset unit 113, a threshold voltage detection unit 111, a deterioration voltage detection unit 112, a data processing unit 114, and an adder unit 115.

The reset unit 113 is connected to the reference voltage line Ref and the second input/output terminal 102, and configured to transmit a signal provided from the reference voltage line Ref to the second input/output terminal 102, based on a signal from the reset control line SW3. The threshold voltage detection unit 111 is connected to the data line Data, the first input/output terminal 101 and the data processing unit 114, and configured to transmit a voltage signal on the first input/output terminal 101 to the data processing unit 114 based on a signal from the first detection control line SW1. The deterioration voltage detection unit 112 is connected to the second input/output terminal 102 and the data processing unit 114, and configured to transmit a voltage signal on the second input/output terminal 102 to the data processing unit 114 based on a signal from the second detection control line SW2. The data processing unit 114 is connected to the threshold voltage detection unit 111, the deterioration voltage detection unit 112, and the adder unit 115, and configured to process the voltage signals provided from the threshold voltage detection unit 111 and the deterioration voltage detection unit 112, and transmit the processed voltage signals to the adder unit 115. The adder unit 115 is connected to the data processing unit 114, and the data line Data, and configured to provide a compensated voltage signal based on the voltage signal provided from the data processing unit 114 and the voltage signal on the data line Data.

In this embodiment, the threshold voltage detection unit 111 detects a threshold voltage of a driving transistor in an organic light emitting pixel from the first input/output terminal 101, and a compensated data voltage is fed back to the data line Data after the processing by the data processing unit 114 and the addition by the adder unit 115. In this way, the threshold voltage of the organic light emitting pixel is compensated. Meanwhile, the deterioration voltage detection unit 112 detects an anode voltage signal of a light emitting element in an organic light emitting pixel from the second input/output terminal 102, and a compensated data voltage is fed back to the data line Data after the processing by the data processing unit 114 and the addition by the adder unit 115. In this way, deterioration compensation is performed on the light emitting element of the organic light emitting pixel.

The organic light emitting pixel compensation circuit 100*a* may further include a plurality of internal compensation modules 12*a*, and each of the internal compensation modules 12*a* may include a data voltage storage unit 121, a data voltage write unit 122, a reset detection control unit 123, a light emission control unit 124, a light emitting element D1, a driving transistor DT, a light emission control line SW4, a first scan line S1, and a second scan line S2.

The data voltage storage unit 121 is connected to a gate of the driving transistor DT, and configured to store a gate voltage signal of the driving transistor DT. The data voltage write unit 122 is connected to the data line Data and the gate of the driving transistor DT, and configured to transmit a signal from the data line Data to the gate of the driving transistor DT based on a signal from the first scan line S1. The reset detection control unit 123 is connected to an anode of the light emitting element D1 and the second input/output terminal 102, and configured to transmit an anode voltage signal of the light emitting element D1 to the second input/output terminal 102 or transmit a voltage signal of the second input/output terminal 102 to the anode of the light emitting element D1, based on a signal from the second scan line S2. The light emission control unit 124 is connected to a first source voltage terminal VDD and a first electrode of the driving transistor DT, and configured to control the light emission of the light emitting element D1, based on a signal from the light emission control line SW4. A cathode of the light emitting element D1 is connected to a second source voltage terminal VEE. A second electrode of the driving transistor DT is connected to the anode of the light emitting element D1, and the first electrode of the driving transistor DT is connected to the first input/output terminal 101.

The internal compensation module 12*a* may transmit a voltage signal including the threshold voltage of the driving transistor DT to the first input/output terminal 101, and then a compensated data voltage is transmitted to the gate of the driving transistor DT via the data line Data, to accomplish the compensation on the threshold voltage. In addition, the internal compensation module 12*a* may further transmit a voltage signal including the anode voltage of the light emitting element D1 to the second input/output terminal 102, and then a compensated data voltage is transmitted to the gate of the driving transistor DT via the data line Data, to accomplish the deterioration compensation.

Figure 1B:
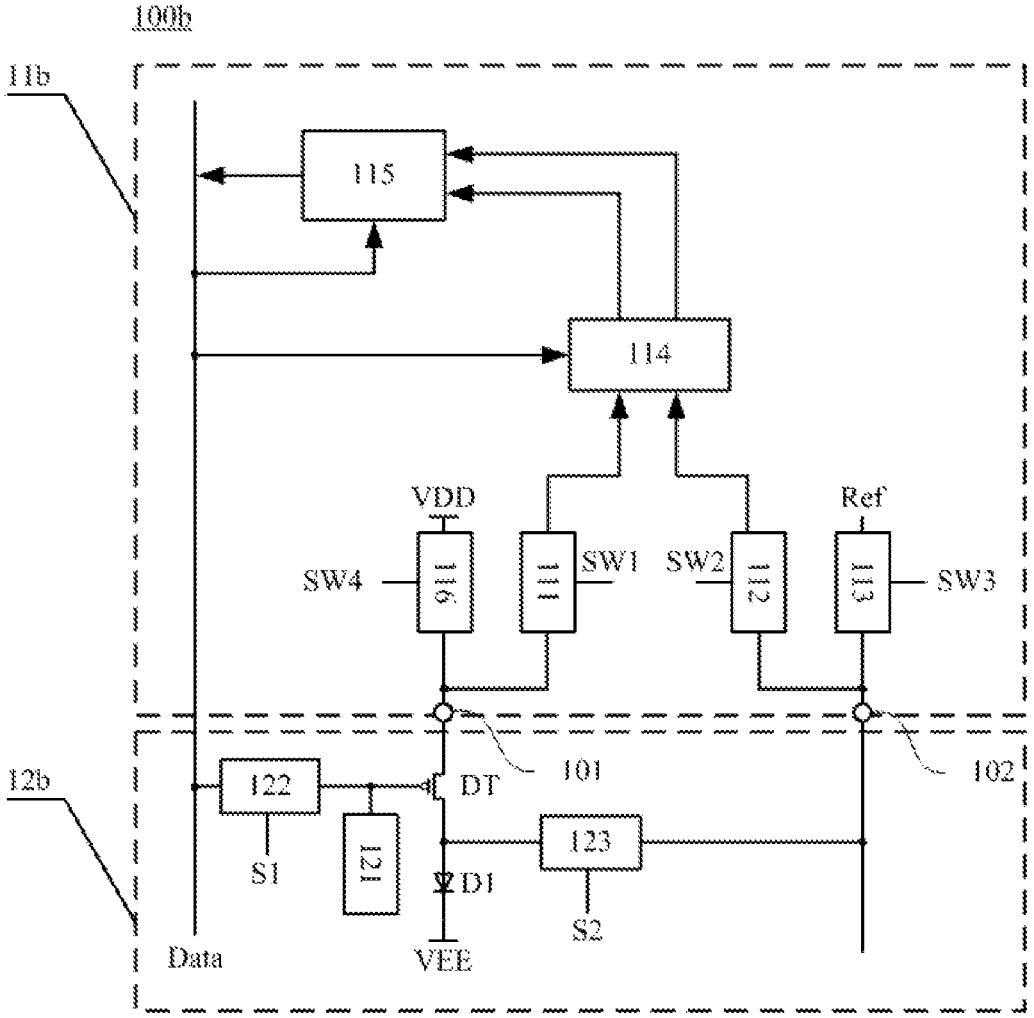
FIG. 1B shows a schematic diagram of another embodiment of an organic light emitting pixel compensation circuit according to the present application.

FIG. 1B shows a schematic diagram of another embodiment of an organic light emitting pixel compensation circuit according to the present application.

The structure of the embodiment shown in FIG. 1B is largely the same as that of the embodiment shown in FIG. 1A. In the following description, the same parts as those in the embodiment shown in FIG. 1A will be omitted and the differences are highlighted.

Unlike the embodiment shown in FIG. 1A, in an organic light emitting pixel compensation circuit 100*b*, the light emission control line SW4 and a light emission control unit 116 may be arranged in an external compensation module 11*b*, as shown in FIG. 1B.

The light emission control unit 116 is connected to the first source voltage terminal VDD and the first input/output terminal 101, and configured to transmit a voltage signal of the first source voltage terminal VDD to the first input/output terminal 101, based on a signal from the light emission control line SW4.

In this embodiment, because the light emission control line SW4 and the light emission control unit 116 are arranged in the external compensation module 11*b*, the circuit structure of the internal compensation module 12*b* is simplified, and the area occupied by the internal compensation module 12*b* is reduced, which facilitates the increase in the aperture ratio of the organic light emitting pixel, and the fabrication of an organic light emitting display panel with a high PPI.

Figure 2A:
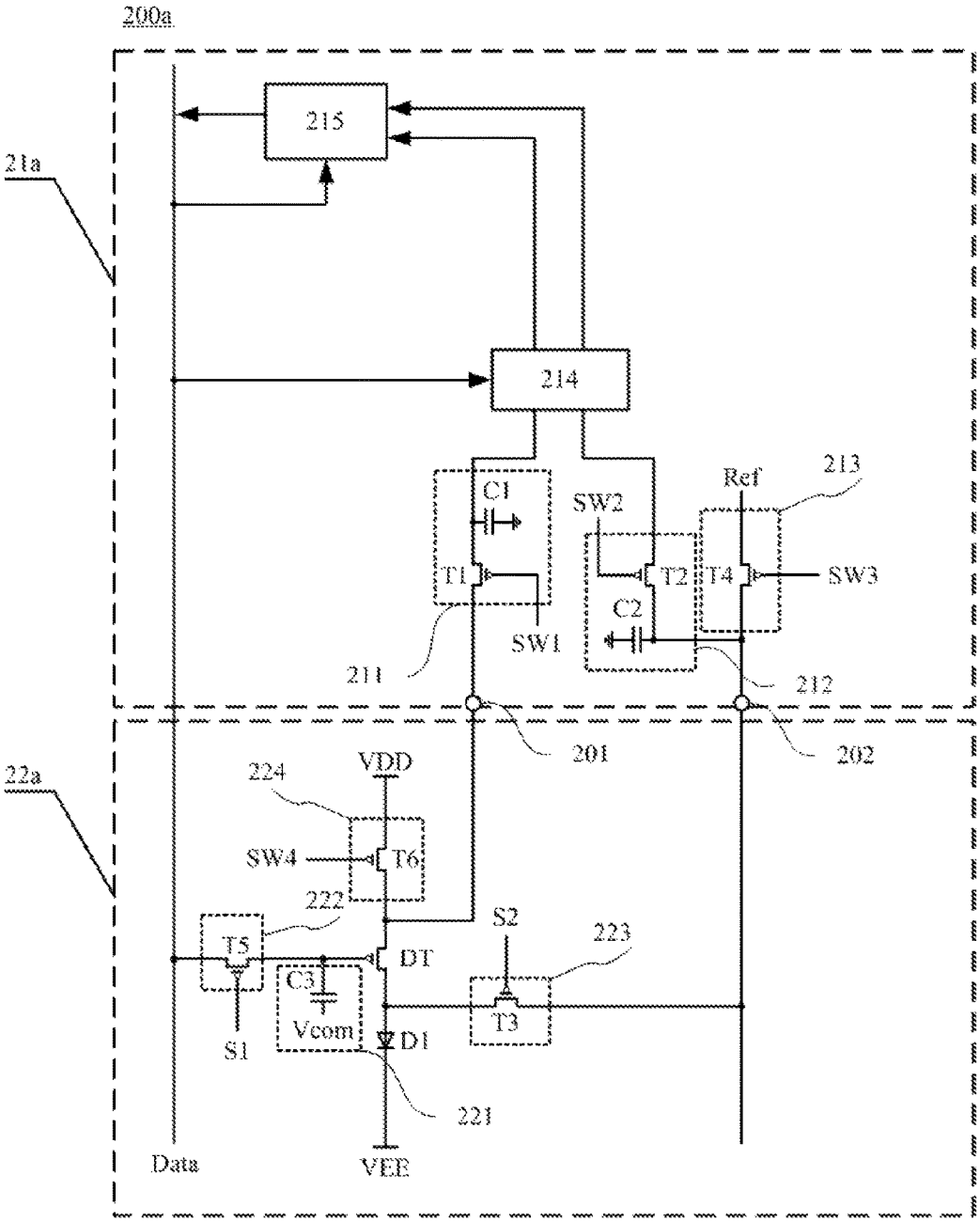
FIG. 2A shows a schematic diagram of an implementation of the organic light emitting pixel compensation circuit shown in FIG. 1A.
Figure 2B:
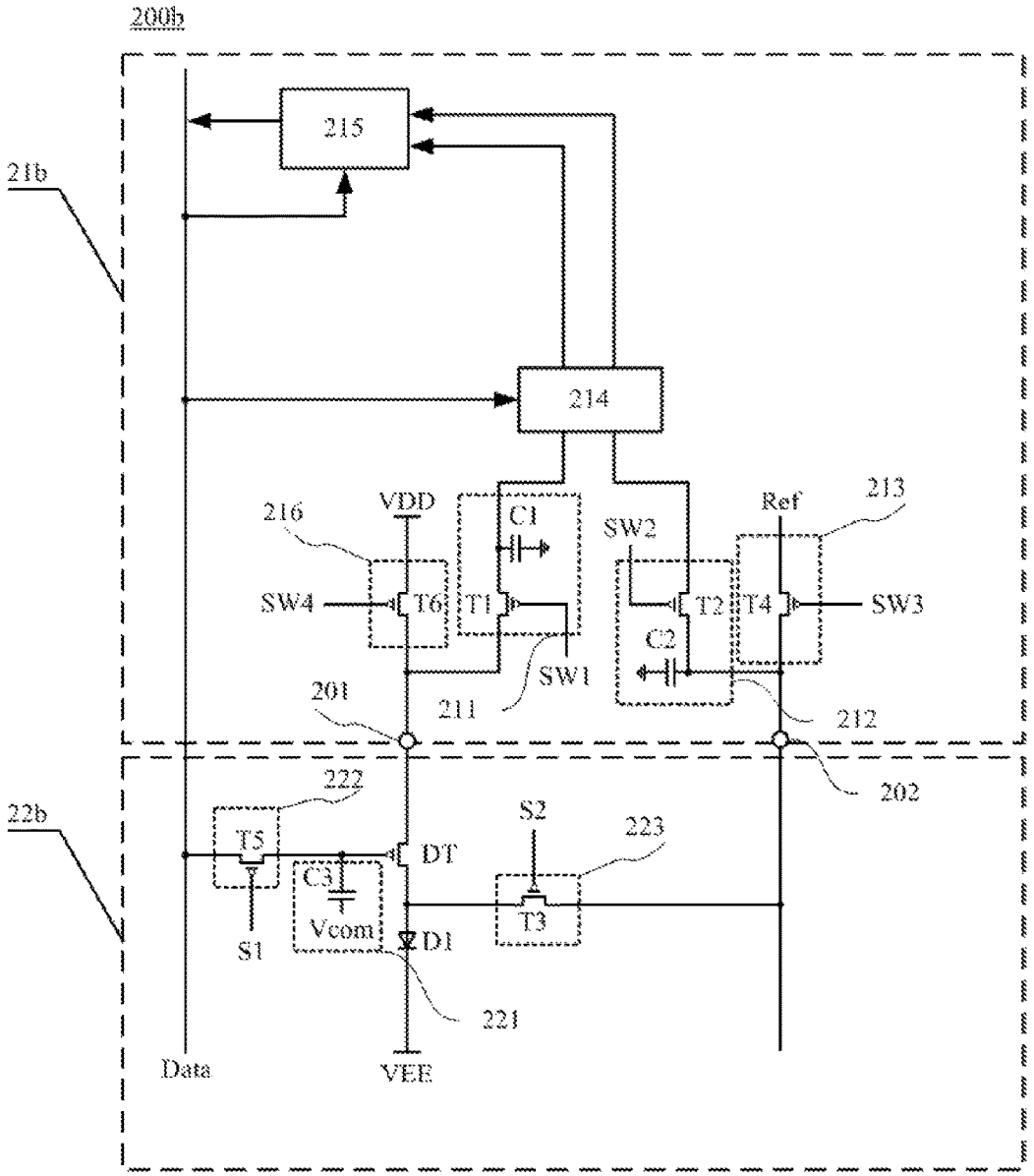
FIG. 2B shows a schematic diagram of an implementation of the organic light emitting pixel compensation circuit shown in FIG. 1B.

FIG. 2A shows a schematic diagram of an implementation of the organic light emitting pixel compensation circuit 100*a* shown in FIG. 1A. FIG. 2B shows a schematic diagram of an implementation of the organic light emitting pixel compensation circuit 100*b* shown in FIG. 1B.

An organic light emitting pixel compensation circuit 200*a* shown in FIG. 2A is a specific implementation of the organic light emitting pixel compensation circuit 100*a* shown in FIG. 1A. Therefore, the organic light emitting pixel compensation circuit 200*a* may similarly include an external compensation module 21*a* and a plurality of internal compensation modules 22*a*. The external compensation module 21*a* may similarly include a data line Data, a reference voltage line Ref, a reset control line SW3, a first detection control line SW1, a second detection control line SW2, a first input/output terminal 201, a second input/output terminal 202, a reset unit 213, a threshold voltage detection unit 211, a deterioration voltage detection unit 212, a data processing unit 214, and an adder unit 215. Each of the internal compensation modules 22*a* may similarly include a data voltage storage unit 221, a data voltage write unit 222, a reset detection control unit 223, a light emission control unit 224, a light emitting element D1, a driving transistor DT, a light emission control line SW4, a first scan line S1, and a second scan line S2.

The implementation shown in FIG. 2A differs from the embodiment shown in FIG. 1A in that the structures of the threshold voltage detection unit 211, the deterioration voltage detection unit 212, the reset detection control unit 223, the reset unit 213, the data voltage storage unit 221, the data voltage write unit 222 and the light emission control unit 224 are specifically described.

The threshold voltage detection unit 211 may include a first switch transistor T1 and a first capacitor C1. A gate of the first switch transistor T1 is connected to the first detection control line SW1, a first electrode of the first switch transistor T1 is connected to the first input/output terminal 201, a second terminal of the first capacitor C1 is grounded, and a second electrode of the first switch transistor T1 and a first terminal of the first capacitor C1 are connected to the data processing unit 214.

The deterioration voltage detection unit 212 may include a second switch transistor T2 and a second capacitor C2. A gate of the second switch transistor T2 is connected to the second detection control line SW2, a first electrode of the second switch transistor T2 and a first terminal of the second capacitor C2 are connected to the second input/output terminal 202, a second terminal of the second capacitor C2 is grounded, and a second electrode of the second switch transistor T2 is connected to the data processing unit 214.

The reset detection control unit 223 may include a third switch transistor T3. A gate of the third switch transistor T3 is connected to the second scan line S2, a first electrode of the third switch transistor T3 is connected to the second input/output terminal 202, and a second electrode of the third switch transistor T3 is connected to an anode of the light emitting element D1.

The reset unit 213 may include a fourth switch transistor T4. A gate of the fourth switch transistor T4 is connected to the reset control line SW3, a first electrode of the fourth switch transistor T4 is connected to the reference voltage line Ref, and a second electrode of the fourth switch transistor T4 is connected to the second input/output terminal 202.

The organic light emitting pixel compensation circuit 200*a* may further include a common voltage line Vcom. The data voltage storage unit 221 includes a third capacitor C3, and the data voltage write unit 222 includes a fifth switch transistor T5. A first terminal of the third capacitor C3 is connected to a gate of the driving transistor DT, a second terminal of the third capacitor C3 is connected to the common voltage line Vcom, a gate of the fifth switch transistor T5 is connected to the first scan line S1, a first electrode of the fifth switch transistor T5 is connected to the data line Data, and a second electrode of the fifth switch transistor T5 is connected to the gate of the driving transistor DT.

The light emission control unit 224 may include a sixth switch transistor T6. A gate of the sixth switch transistor T6 is connected to the light emission control line SW4, a first electrode of the sixth switch transistor T6 is connected to the first source voltage terminal VDD, a second electrode of the sixth switch transistor T6 is connected to a first electrode of the driving transistor DT.

The organic light emitting pixel compensation circuit 200*b* shown in FIG. 2B is a specific implementation of the organic light emitting pixel compensation circuit 100*b* shown in FIG. 1B. The structure of the organic light emitting pixel compensation circuit 200*b* shown in FIG. 2B is largely the same as that of the organic light emitting pixel compensation circuit 200*a* shown in FIG. 2A. In the following description, the same parts as those in the organic light emitting pixel compensation circuit 200*a* shown in FIG. 2A will be omitted and the differences are highlighted.

Unlike the organic light emitting pixel compensation circuit 200*a* shown in FIG. 2A, no light emission control unit is arranged in an internal compensation module 22*b*, and the light emission control line SW4 and a light emission control unit 216 may be arranged in an external compensation module 21*b*, as shown in FIG. 2B.

The light emission control unit 216 may include a sixth switch transistor T6. A gate of the sixth switch transistor T6 is connected to the light emission control line SW4, a first electrode of the sixth switch transistor T6 is connected to the first source voltage terminal VDD, a second electrode of the sixth switch transistor T6 is connected to the first input/output terminal 201.

Although the first switch transistor T1, the second switch transistor T2, the third switch transistor T3, the fourth switch transistor T4, the fifth switch transistor T5, the sixth switch transistor T6, and the driving transistor DT shown in FIGS. 2A and 2B are all PMOS transistors, and the third capacitor C3 is connected to the common voltage line Vcom, these are merely exemplary. It should be understood that all or some of the first switch transistor T1, the second switch transistor T2, the third switch transistor T3, the fourth switch transistor T4, the fifth switch transistor T5, the sixth switch transistor T6, and the driving transistor DT may be an NMOS (Negative channel Metal Oxide Semiconductor) transistor, and the third capacitor C3 may be connected to the first electrode or the second electrode of the driving transistor DT. These may be set by a person skilled in the art according to the needs in practical application scenarios.

Optionally, the organic light emitting pixel compensation circuit may further include a threshold voltage storage unit and a deterioration voltage storage unit connected to the data processing unit.

As shown in FIG. 1A, the organic light emitting pixel compensation circuit 100*a* may further include a threshold voltage storage unit 117 and a deterioration voltage storage unit 118. The threshold voltage storage unit 117 is connected to the data processing unit 114, and configured to store the threshold voltage provided from the data processing unit 114. The deterioration voltage storage unit 118 is connected to the data processing unit 114, and configured to store the deterioration voltage provided from the data processing unit 114.

For example, after the threshold compensation is performed on the driving transistor DT in the organic light emitting pixel compensation circuit 100*a*, the threshold voltage may be stored in the threshold voltage storage unit; and after the deterioration compensation is performed on the light emitting element D1 in the organic light emitting pixel compensation circuit 100*a*, the deterioration voltage may be stored in the deterioration voltage storage unit.

As such, before the data processing unit transmits the threshold voltage to the adder unit, the threshold voltage is compared with that stored in the threshold voltage storage unit. If the threshold voltage is different from that stored in the threshold voltage storage unit, the threshold voltage is transmitted to the adder unit, for compensating the threshold voltage of the driving transistor.

Similarly, before the data processing unit transmits the deterioration voltage to the adder unit, the deterioration voltage is compared with that stored in the deterioration voltage storage unit. If the deterioration voltage is different from that stored in the deterioration voltage storage unit, the deterioration voltage is transmitted to the adder unit, for performing deterioration compensation on the light emitting element.

Optionally, the organic light emitting pixel compensation circuit may further include a driving circuitry, in which a lookup table memory is arranged, and configured to store current-voltage characteristic parameters of the light emitting element.

As shown in FIG. 1A, the organic light emitting pixel compensation circuit 100*a* may further include a driving circuitry 110, where a lookup table memory 119 is arranged, and configured to store current-voltage characteristic parameters of the light emitting element D1.

As such, during deterioration compensation at a later time, the data processing unit may transmit the anode voltage signal obtained by the deterioration voltage detection unit to the lookup table memory in the driving circuitry, and may look up the deterioration voltage of the light emitting element D1, and transmit the deterioration voltage to the adder unit for performing deterioration compensation on the light emitting element D1, thereby simplifying the process for processing the anode voltage signal by the data processing unit.

Figure 3:
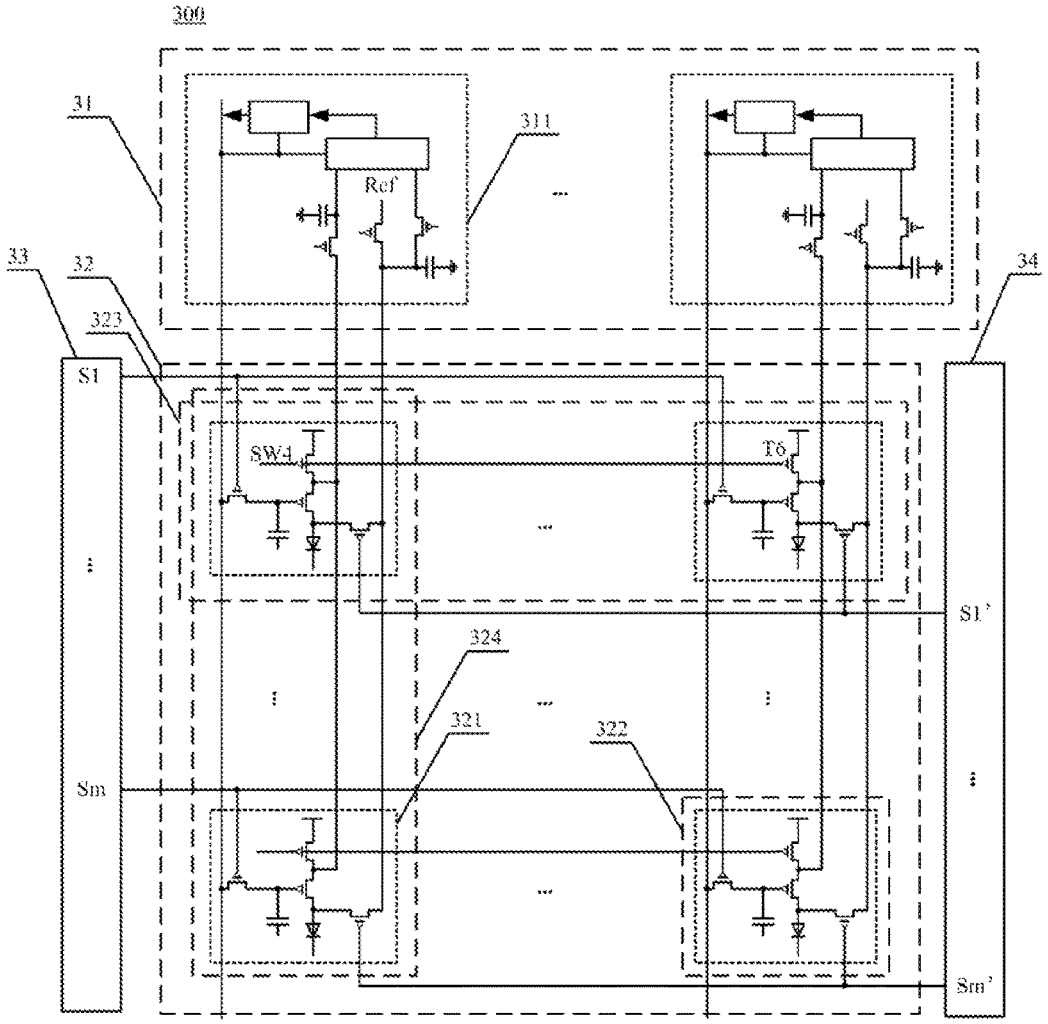
FIG. 3 shows a schematic diagram of an embodiment of an organic light emitting display panel according to the present application.

FIG. 3 shows a schematic diagram of an embodiment of an organic light emitting display panel according to the present application.

As shown in FIG. 3, an organic light emitting display panel 300 may include a display region 32 and a non-display region 31 surrounding the display region 32. A plurality of external compensation modules 311 is arranged in the non-display region 31, and each of the external compensation modules 311 has the same circuit structure as that of the external compensation module 21*a* shown in FIG. 2A.

In this embodiment, the threshold voltage detection unit detects a threshold voltage of a driving transistor in an organic light emitting pixel from the first input/output terminal, and a compensated data voltage is fed back to the data line after the processing by the data processing unit and the addition by the adder unit. In this way, the threshold voltage of the organic light emitting pixel is always compensated. Meanwhile, the deterioration voltage detection unit detects an anode voltage signal of alight emitting element in an organic light emitting pixel from the second input/output terminal, and a compensated data voltage is fed back to the data line after the processing by the data processing unit and the addition by the adder unit. In this way, the deteriorated voltage of the organic light emitting pixel is compensated to remain constant.

The display region 32 may include a plurality of rows of pixel units 323 and a plurality of columns of pixel units 324. Each row of the pixel units 323 may include a plurality of sub-pixels 322, and each column of the pixel units 324 may include a plurality of sub-pixels 322. An internal compensation module 321 may be arranged in each of the sub-pixels 322, and the internal compensation module 321 may have the same circuit structure as that of the internal compensation module 22*a* shown in FIG. 2A.

The internal compensation module 321 may transmit a voltage signal including the threshold voltage of the driving transistor to the first input/output terminal, and then a compensated data voltage from the external compensation module 311 is transmitted to the gate of the driving transistor via the data line, to accomplish the compensation on the threshold voltage. In addition, the internal compensation module 321 may further transmit a voltage signal including the anode voltage of the light emitting element to the second input/output terminal, and then a compensated data voltage from the external compensation module 311 is transmitted to the gate of the driving transistor via the data line, to accomplish the deterioration compensation.

Figure 4:
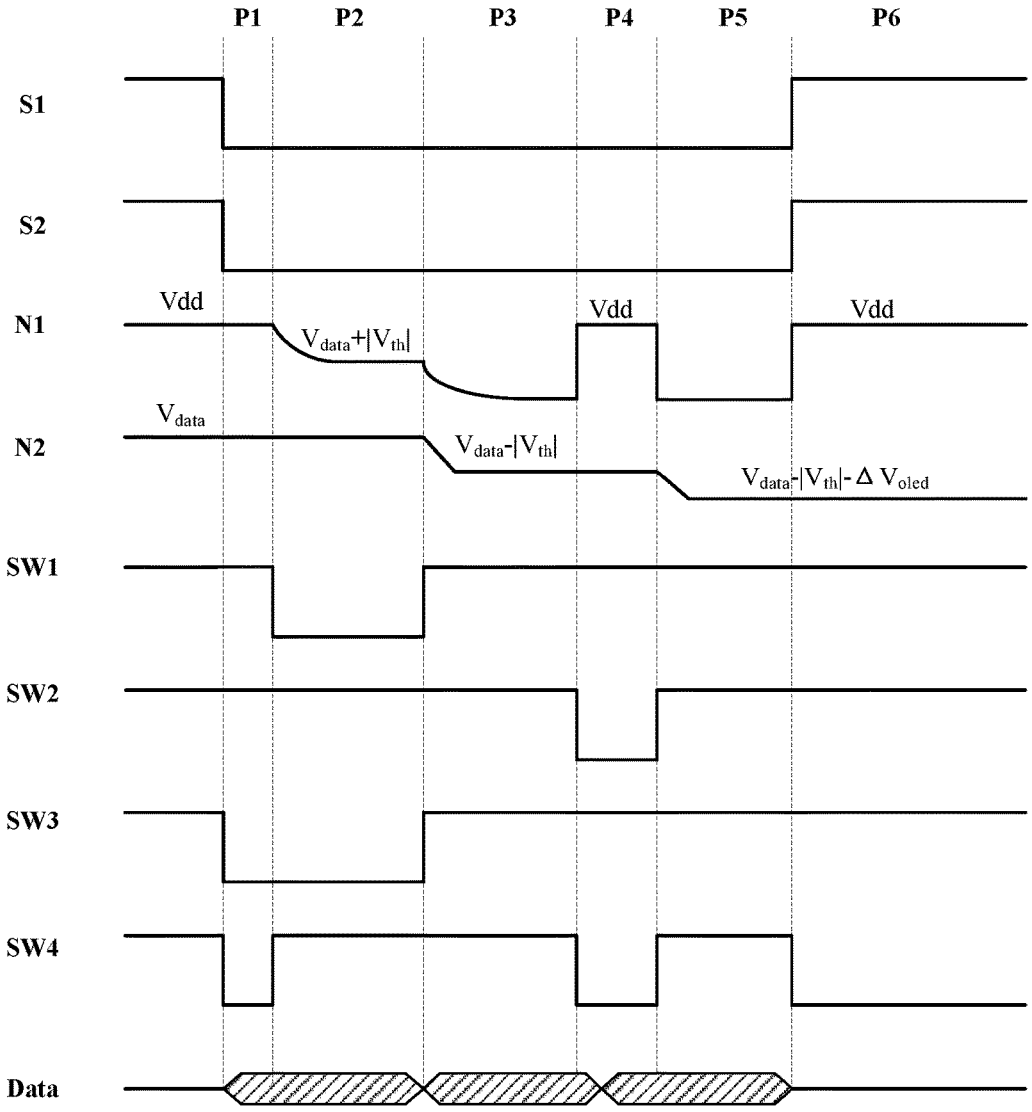
FIG. 4 shows a timing diagram of the organic light emitting display panel shown in FIG. 3.

The working principle of the organic light emitting display panel 300 shown in FIG. 3 is described by way of examples in which the first switch transistor, the second switch transistor, the third switch transistor, the fourth switch transistor, the fifth switch transistor, the sixth switch transistor and the driving transistor are all PMOS transistors, with reference to the circuit diagram shown in FIG. 2A, the timing diagram shown in FIG. 4, and the equivalent circuit diagrams shown in FIGS. 5A to 5F.

Figure 5A:
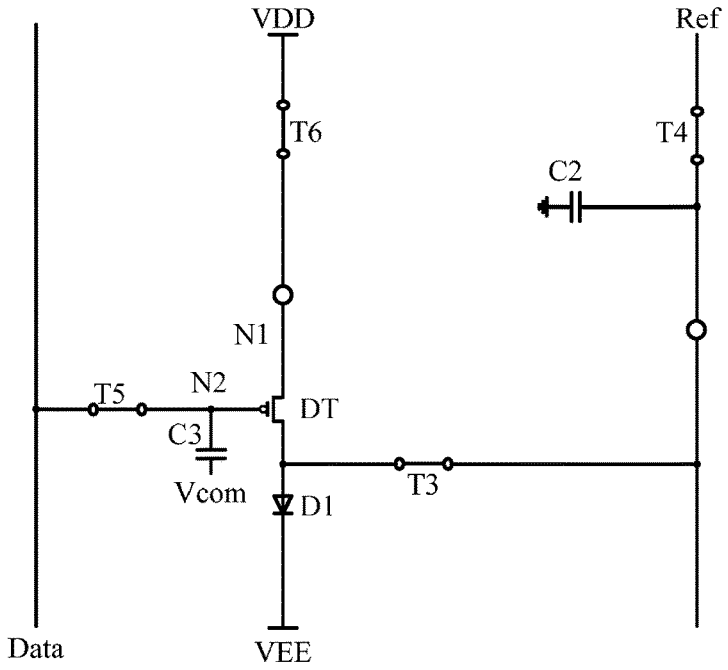
FIGS. 5A to 5F show equivalent schematic diagrams of the organic light emitting pixel compensation circuit on the organic light emitting display panel shown in FIG. 3 in various stages shown in FIG. 4.

The timing diagram in FIG. 4 is divided in 6 stages P1 to P6. Stage P1: The data line Data provides a data voltage signal $V_{data}$, the reference voltage line Ref provides a reference voltage signal $V_{ref}$, and the first source voltage terminal VDD in FIG. 5A provides a first voltage signal Vdd. The first scan line S1, the second scan line S2, the reset control line SW3, and the light emission control line SW4 are set at a low level signal. and The fifth switch transistor T5 connected to S1, the third switch transistor T3 connected to S2, the sixth switch transistor T6 connected to SW4, the fourth switch transistor T4 connected to SW3, and the driving transistor DT connected to N2, are turned on (for PNP type transistors).

An equivalent circuit diagram of the organic light emitting pixel compensation circuit 200*a* is as shown in FIG. 5A.

In this stage, the potential $V_g$ at the gate (that is, the node N2) of the driving transistor DT is $V_{data}$, the potential $V_s$ at a source (that is, the first electrode or the node N1 of the driving transistor DT) of the driving transistor DT is Vdd, and the anode potential $V_{oled+}$ of the light emitting element D1 is $V_{ref}$.

Figure 5B:
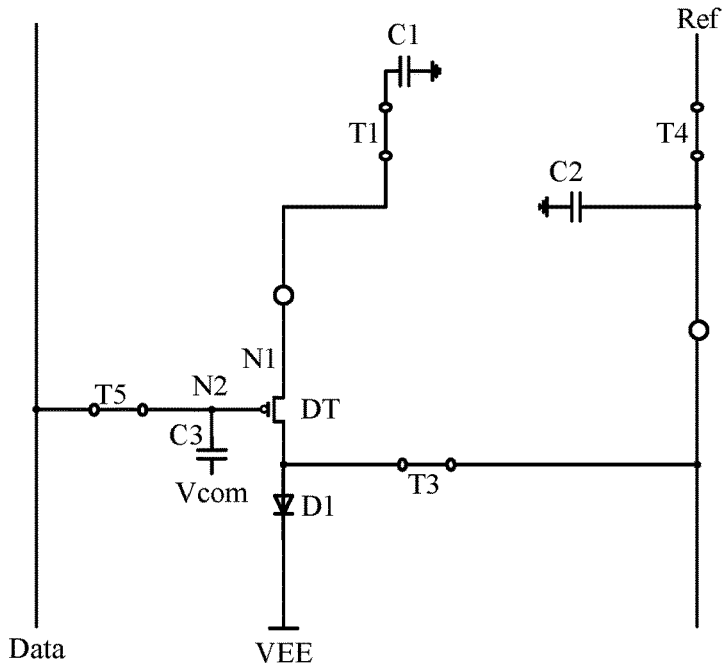

Stage P2: The light emission control line SW4 provides a high level signal, the first detection control line SW1 provides a low level signal, the sixth switch transistor T6 connected to SW4 is turned off, and the first switch transistor T1 connected to SW1 is turned on. An equivalent circuit diagram of the organic light emitting pixel compensation circuit 200*a* is as shown in FIG. 5B.

In this stage, the source of the driving transistor DT discharges to the first capacitor C1, the source potential $V_s$ is gradually decreased from Vdd to $V_{data}+|V_{th}|$, the discharge is stopped, and the source potential $V_s$ is maintained by the first capacitor C1. Here, $V_{th}$ is the threshold voltage of the driving transistor DT.

Figure 5C:
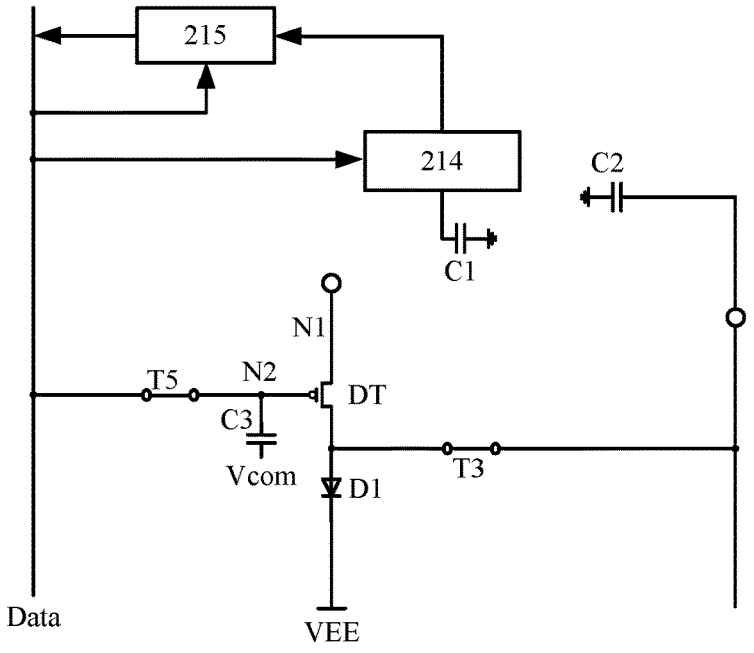

Stage P3: The first detection control line SW1 and the reset control line SW3 provide a high level signal, and the first switch transistor T1 connected to SW1 and the fourth switch transistor T4 connected to SW3 are turned off. An equivalent circuit diagram of the organic light emitting pixel compensation circuit 200*a* is as shown in FIG. 5C.

In this stage, the data processing unit 214 acquires the source potential $V_s$ from the first capacitor C1, acquires the voltage signal $V_{data}$ from the data line Data and processes them (for example, performs subtraction of the two voltage signals, $V_s-V_{data}$), to obtain the threshold voltage $|V_{th}|$, and transmit the threshold voltage $|V_{th}|$ to the adder unit 215. After addition by the adder unit 215, a compensated data voltage signal $V_{data}'$ ($V_{data}'=V_{data}-|V_{th}|$) is fed back to the gate (that is, the node N2) of the driving transistor DT via the data line Data. The compensated data voltage signal $V_{data}'$ is maintained by the third capacitor C3.

Figure 5D:
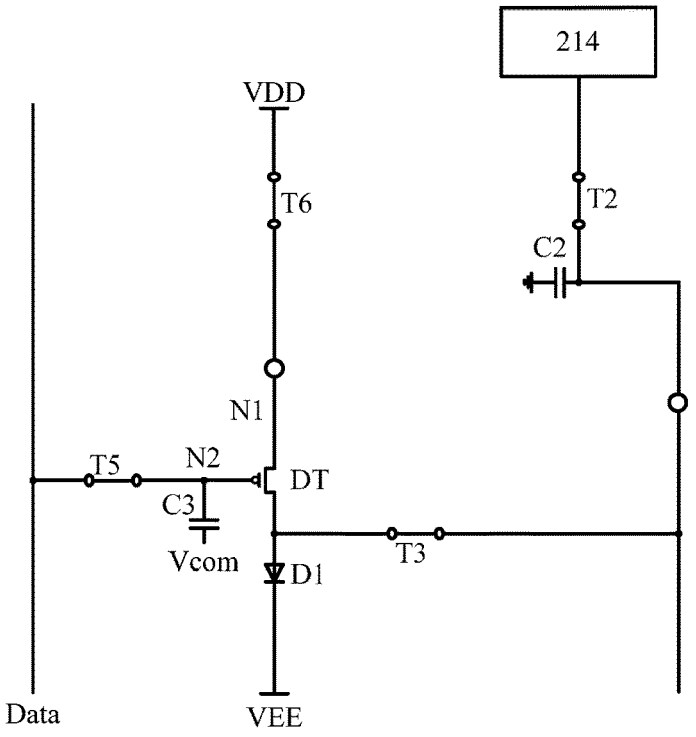

Stage P4: The second detection control line SW2 and the light emission control line SW4 provide a low level signal, and the second switch transistor T2 connected to SW2, the sixth switch transistor T6 connected to SW4, and the driving transistor DT, connected to N1 at its source, are turned on. An equivalent circuit diagram of the organic light emitting pixel compensation circuit 200*a* is as shown in FIG. 5D.

In this stage, the potential $V_s$ at the source (that is, the node N1) of the driving transistor DT is Vdd, the potential $V_g$ at the gate (that is, the node N2) of the driving transistor DT is $V_{data}'$, and the anode potential $V_{oled+}$ of the light emitting element D1 is transmitted through the third switch transistor T3 and the second switch transistor T2 to the data processing unit 214.

A transistor's current in a saturated region is calculated by the formula:

$$I=k(|V_{gs}|-|V_{th}|)^2(1+\lambda\cdot V_{ds}) \quad (1)$$

Therefore the light-emitting current flowing through the light-emitting element D1 in Stage P4 is calculated to be:

$$I_{oled}=k(Vdd-V_{data}'-|V_{th}|)^2(1+\lambda(Vdd-V_{oled+})) \quad (2)$$

where $V_{gs}$ is the potential difference between the gate and the source of the driving transistor DT, $V_{ds}$ is the potential difference between the source and the drain (the second electrode of the driving transistor DT) of the driving transistor DT, and λ is a channel length modulation parameter; k is calculated from:

$$k = \frac{1}{2}\mu c_{ox}\frac{w}{l};$$

where μ is the channel mobility of the driving transistor DT, $c_{ox}$ is the gate oxide capacitance per unit area of the driving transistor DT, and $$\frac{w}{l}$$

is width-to-length ratio of the channel of the driving transistor DT.

By simplifying Formula (2), the light-emitting current flowing through the light-emitting element D1 in Stage P4 is $$I_{oled}=k(Vdd-V_{data})^2(1+\lambda(Vdd-V_{oled+})) \quad (3)$$

It can be seen from Formula (3) that the light-emitting current $I_{oled}$ is independent of the threshold voltage $V_{th}$ of the driving transistor DT. Therefore, in case that the anode voltage Vdada of the light emitting element D1 is kept unchanged, the constant light-emitting current $I_{oled}$ can be obtained as long as the first voltage signal Vdd and data voltage signal $V_{data}$ are applied to the organic light emitting display panel 300 in this embodiment, thereby avoiding the influence of the threshold voltage $V_{th}$ of the driving transistor DT on the light emitting current $I_{oled}$. As a result, the display unevenness due to the threshold difference of the driving transistor DT is avoided.

Figure 5E:
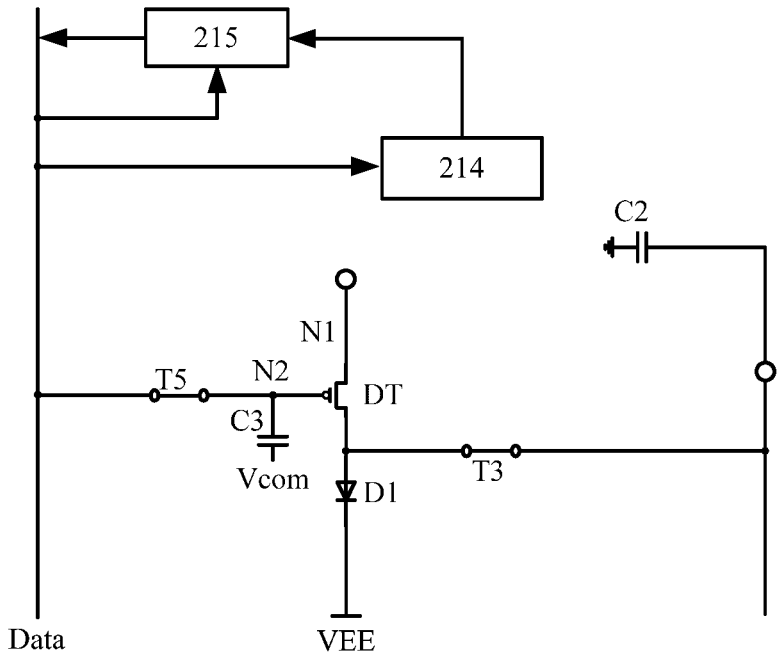

In Stage P5, the second detection control line SW2 and the light emission control line SW4 provide a high level signal, and the second switch transistor T2 connected to SW2 and the sixth switch transistor T6 connected to SW4 are turned off. An equivalent circuit diagram of the organic light emitting pixel compensation circuit 200*a* is as shown in FIG. 5E.

The external data processing unit 214 processes the anode voltage signal $V_{oled+}$, to obtain a deterioration voltage $\Delta V_{oled}$ of the light emitting element D1, and transmits the obtained deterioration voltage $\Delta V_{oled}$ to the external adder unit 215. After addition by the adder unit 215, a compensated data voltage signal $V_{data}''$ ($V_{data}''=V_{data}-|V_{th}|-\Delta V_{oled}$) is fed back to the gate (that is, the node N2) of the driving transistor DT via the data line Data, and the compensated data voltage $V_{data}''$ is therefore maintained by the third capacitor C3.

A process for processing the anode voltage signal $V_{oled+}$ by the data processing unit 214 to obtain the deterioration voltage $\Delta V_{oled}$ is as described below. A forward voltage $V_{oled}$ ($V_{oled}=V_{oled}-$Vee, where Vee is a voltage signal provided by the second source voltage terminal VEE) of the light emitting element D1 is calculated; a current value corresponding to the forward voltage $V_{oled}$ of the light emitting element D1 is obtained based on the previously stored current-voltage characteristic parameters of the light emitting element; the brightness of the light emitting element D1 is calculated from the current value; and if the decay of the brightness of the light emitting element D1 (relative to the original brightness of the light emitting element D1) exceeds a preset value (for example, 3%), deterioration compensation of the light emitting element is needed, and a deterioration voltage $\Delta V_{oled}$ is obtained based on the previously stored current-voltage characteristic parameters of the light emitting element.

Figure 5F:
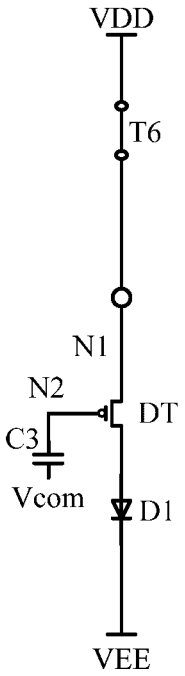

In stage P6, the first scan line S1 and the second scan line S2 provide a high level signal, the light emission control line SW4 provides a low level signal, the fifth switch transistor T5 and the third switch transistor T3 are turned off, the sixth switch transistor T6 and the driving transistor DT are turned on, and the light emitting element D1 emits light. An equivalent circuit diagram of the organic light emitting pixel compensation circuit 200*a* is as shown in FIG. 5F.

The potential $V_s$ at the source (that is, the node N1) of the driving transistor DT is Vdd, the potential $V_g$ at the gate (that is, the node N2) of driving transistor DT is $V_{data}''$, and the light emitting current flowing through the light emitting element D1 is $$I_{oled}=k(Vdd-V_{data}+\Delta V_{oled})^2(1+\lambda(Vdd-V_{oled+})) \quad (4)$$

As can be known from comparison of Formulas (3) and (2), after deterioration compensation of the light emitting element D1, the light emitting current $I_{oled}$ is increased. In case of brightness decay of the organic light emitting display panel 300 according to this embodiment after long time of use, the light emitting current is increased by means of deterioration compensation, thereby avoiding the brightness decay caused by deterioration of the light emitting element D1, and effectively extending the service life of the organic light emitting display panel 300.

The sixth switch transistor T6 and the light emission control line SW4 may be arranged in the internal compensation module 321 of the sub-pixel 322, and the light emission control lines SW4 of the sub-pixels 322 in the same row of pixel units 323 are connected together. That is to say, the sixth switch transistors T6 in the same row of pixel units 323 may share a common light emission control line SW4, and the first voltage signal Vdd controls the simultaneous light emission of the sub-pixels 322 in the same row of pixel units 323, based on a signal from the light emission control line SW4.

As such, the threshold voltage of the driving transistor DT and the deterioration voltage of the light emitting element D1 can be compensated with one row of pixel units 323 as a unit, thereby increasing the signal processing speed.

The internal compensation modules 321 in the sub-pixels 322 of the same column of pixel units 324 may be connected to the same external compensation module 311.

At least two adjacent columns of the pixel units 324 may be connected to a same reference voltage line. The sub-pixels 322 in at least two adjacent columns of the pixel units 324 may share a common reference voltage line Ref, whereby wiring of the reference voltage line Ref in the sub-pixel 322 is reduced. Correspondingly, at least two adjacent external compensation modules 311 may share a common reset unit (not shown), which simplifies the circuit structure of the external compensation module, and reduces the area occupied by the external compensation module 311.

Optionally, the external compensation modules 311 may share a common data processing unit. Correspondingly, the external compensation modules 311 may share a common adder unit. In this manner, the circuit structure of the external compensation module 311 is further simplified, and the area occupied by the external compensation module 311 is further reduced.

Optionally, a threshold voltage storage unit (not shown) and a deterioration voltage storage unit (not shown) may also be arranged in the non-display region 31 of the organic light emitting display panel 300. The threshold voltage storage unit is connected to the data processing unit, and configured to store the threshold voltage provided by the data processing unit; and the deterioration voltage storage unit is connected to the data processing unit, and configured to store the deterioration voltage provided by the data processing unit.

For example, in FIG. 3 after threshold compensation is performed on the driving transistor in the sub-pixel 322, the threshold voltage may be stored in the threshold voltage storage unit; and after deterioration compensation is performed on the light emitting element in the sub-pixel 322, the deterioration voltage is stored in the deterioration voltage storage unit.

As such, before the data processing unit transmits the threshold voltage to the adder unit, the threshold voltage is compared with that stored in the threshold voltage storage unit. If the threshold voltage is different from that stored in the threshold voltage storage unit, the threshold voltage is transmitted to the adder unit, for compensating the threshold voltage of the driving transistor in the sub-pixel 322.

Similarly, before the data processing unit transmits the deterioration voltage to the adder unit, the deterioration voltage is compared with that stored in the deterioration voltage storage unit. If the deterioration voltage is different from that stored in the deterioration voltage storage unit, the deterioration voltage is transmitted to the adder unit, for performing deterioration compensation on the light emitting element in the sub-pixel 322.

Optionally, a driving circuitry (not shown) is further arranged in the non-display region 31 of the organic light emitting display panel 300, in which a lookup table memory is arranged, and configured to store current-voltage characteristic parameters of the light emitting element.

All the pixel units on the organic light emitting display panel may be pre-compensated (including threshold compensation and deterioration compensation), and the current-voltage characteristic parameters of the light emitting element before and after compensation are stored in the lookup table memory.

As such, during deterioration compensation at a later time, the data processing unit may transmit the anode voltage signal obtained by the deterioration voltage detection unit to the lookup table memory, to look up the deterioration voltage of the light emitting element, and transmit the deterioration voltage to the adder unit for performing deterioration compensation on the light emitting element in the sub-pixel 322, thereby simplifying the process for processing the anode voltage signal by the data processing unit In this embodiment, each row of the pixel units may be connected with one first scan line and one second scan line.

For example, in some application scenarios, the signals from the first scan lines S1-$S_m$ and the signals from the second scan line S1'-$S_m$' are generated respectively by a shift register 33 and a shift register 34, shown in FIG. 3. In these application scenarios, the signals from the first scan line S1-$S_m$ may have the same waveform as scan line S1 in FIG. 4, and the signal from the second scan line S1'-$S_m$' may have the same waveform as scan line S2 in FIG. 4.

In addition, the internal compensation module 321 in each sub-pixel 322 on the organic light emitting display panel 300 includes, in addition to the driving transistor and the light emitting element, only three switch transistors (for example, the fifth switch transistor, the sixth switch transistor, and the third switch transistor) and one storage capacitor, the circuit structure is simple, and the threshold compensation and the deterioration compensation can be accomplished only by transmitting a voltage signal including the threshold voltage of the driving transistor and the anode voltage signal of the light emitting element to the external compensation module 311. Therefore, the present invention is applicable to the organic light emitting display devices of various sizes.

Figure 6:
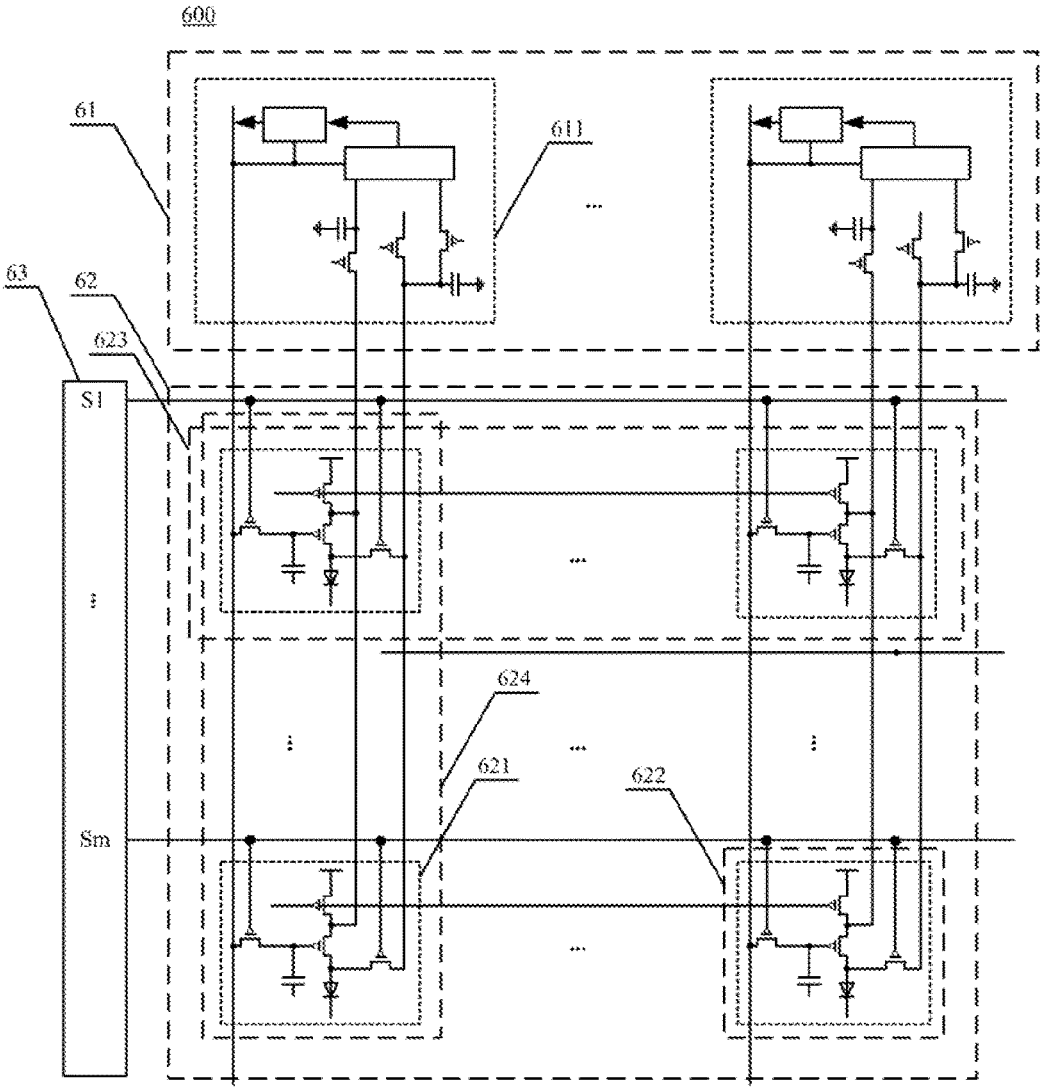
FIG. 6 shows a schematic diagram of another embodiment of an organic light emitting display panel according to the present application.

FIG. 6 shows a schematic diagram of another embodiment of an organic light emitting display panel according to the present application.

The structure compensation circuitry of the embodiment shown in FIG. 6 is largely the same as that of the embodiment shown in FIG. 3. A non-display region 61 of an organic light emitting display panel 600 also encloses a plurality of external compensation modules 611 arranged therein; and a display region 62 also include a plurality of rows of pixel units 623 and a plurality of columns of pixel units 624. An internal compensation module 621 is also arranged in each sub-pixel 622 of the pixel unit 623/624.

This embodiment in FIG. 6 differs from the embodiment shown in FIG. 3 in that one row of pixel units are connected with one scan line.

It can be known from the waveforms of S1 and S2 in FIG. 4 that the first scan line and the second scan line may have the same waveform. Therefore, the first scan line and second scan line may share a common scan line.

Specifically, as shown in FIG. 6, the scan line S1 may be connected to the data voltage write unit and the reset detection control unit of a first column of pixel units 623, such that the data voltage write unit can transmit a signal from the data line to the gate of the driving transistor based on a signal from the scan line S1, and the reset detection control unit transmit the anode voltage of the light emitting element to the second input/output terminal or transmit the voltage of the second input/output terminal to the anode of the light emitting element, based on a signal from the scan line S1. Similarly, a scan line $S_m$ is connected to the data voltage write unit and the reset detection control unit of an mth row of pixel units 623.

Correspondingly, the scan lines S1-$S_m$ may be provided by a shift register 63, whereby the area occupied by the internal compensation module 621 is further reduced.

Figure 7:
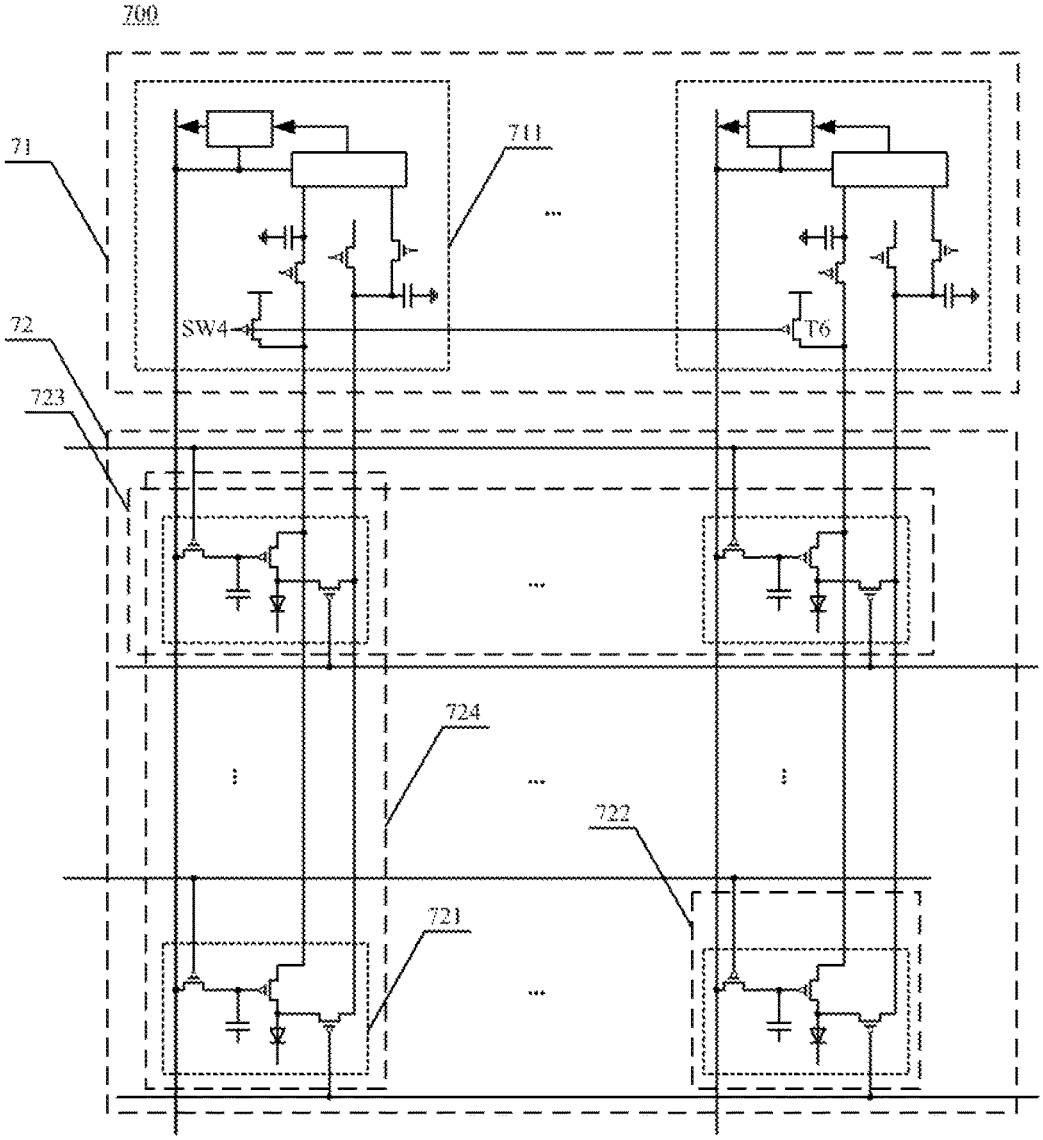
FIG. 7 shows a schematic diagram of another embodiment of an organic light emitting display panel according to the present application.

FIG. 7 shows a schematic diagram of another embodiment of an organic light emitting display panel according to the present application.

The structure of the circuitry of the embodiment shown in FIG. 7 is largely the same as that of the embodiment shown in FIG. 3. A non-display region 72 of an organic light emitting display panel 700 also has a plurality of external compensation modules 711 arranged therein and a display region 72 also include a plurality of rows of pixel units 723 and a plurality of columns of pixel units 724. An internal compensation module 721 is also arranged in each sub-pixel 722 of the pixel units 723/724.

Unlike the embodiment shown in FIG. 3, in the organic light emitting display panel 700, the sixth switch transistor T6 and the light emission control line SW4 may be arranged in the external compensation module 711, each column of pixel units 724 may be connected to one sixth switch transistor T6, and each sixth switch transistor may share a common light emission control line SW4, as shown in FIG. 7. The first voltage signal Vdd can control the simultaneous light emission of all the sub-pixels 722 on the organic light emitting display panel 700, based on a signal from the light emission control line SW4.

This embodiment has the following benefits.

On one hand, the sixth switch transistor T6 and the light emission control line SW4 are migrated from the internal compensation module 721 in each sub-pixel 722 of the display region 72 into the external compensation module 711 in the non-display region 71, which not only simplifies the circuit structure of the internal compensation module 721, but also reduces the area occupied by the internal compensation module 721 in the sub-pixel 722, thus facilitating the increase in the aperture ratio of the sub-pixel 722, and also the fabrication of an display panel with a high PPI.

On the other hand, the sixth switch transistor T6 and the light emission control line SW4 are arranged in the external compensation module 711, and the sixth switch transistor T6 and the light emission control line SW4 are effectively multiplexed, which simplifies the circuit structure of the organic light emitting display panel 700.

Moreover, because the first voltage signal Vdd can control the simultaneous light emission of all the sub-pixels 722 on the organic light emitting display panel 700 based on a signal from the light emission control line SW4, all the sub-pixels 722 on the organic light emitting display panel 700 can be collectively compensated. After all the sub-pixels 722 are compensated, all the sub-pixels 722 on the organic light emitting display panel 700 emit light based on a signal from the light emission control line SW4. In this way, visual discomforts caused by line-by-line scan, such as tailing and the like, are avoided. Particularly, when the display panel 700 is applied in a VR (Virtual Reality) device, the visual discomforts during scanning are avoided, thus eliminating the discomfort of a user such as dizziness and the like.

Moreover, the present application further discloses a method for driving an organic light emitting display panel, including the organic light emitting display panels according to various embodiments above.

Figure 8:
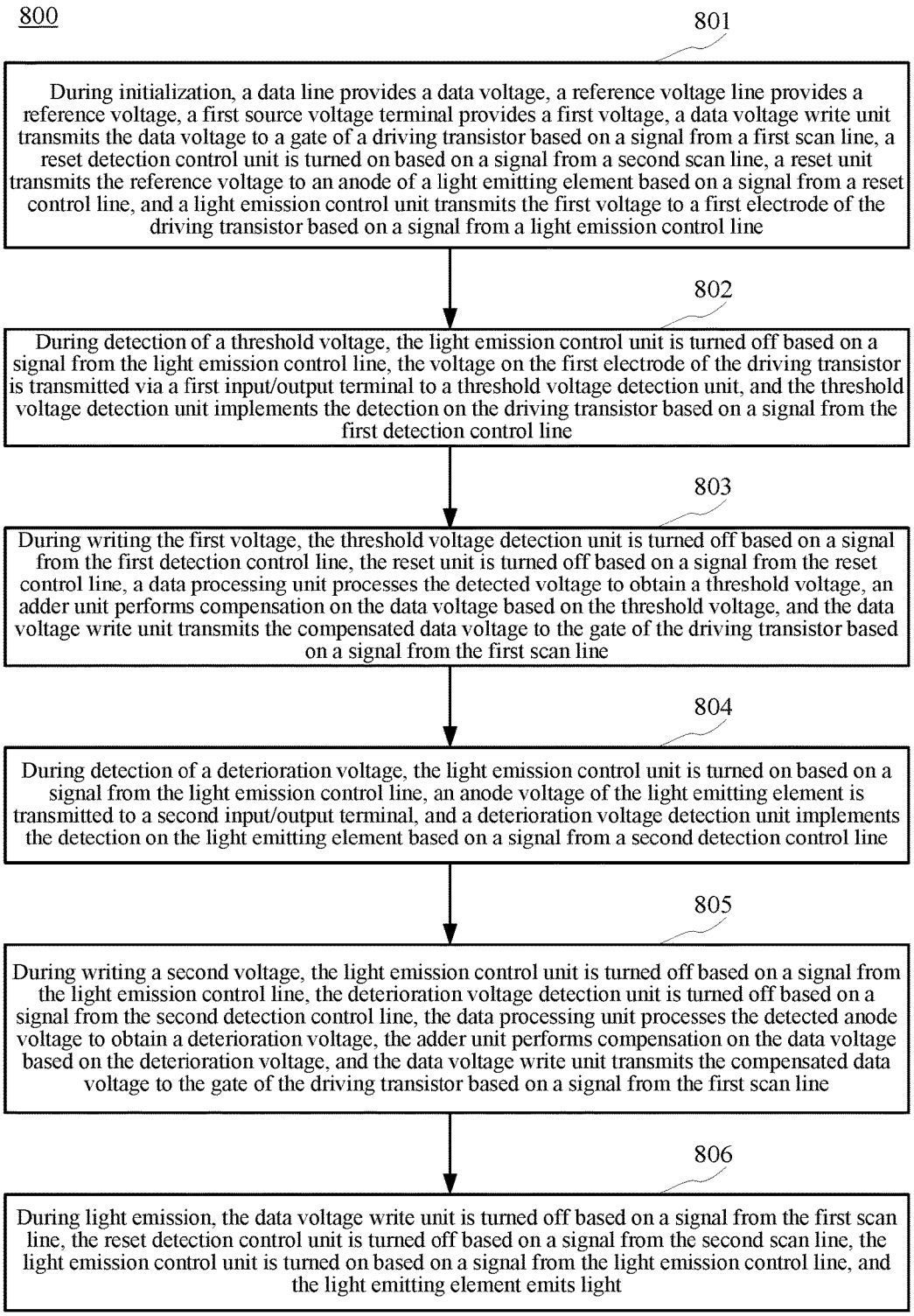
FIG. 8 shows a schematic flow chart of a method for driving the organic light emitting display panels according to various embodiments of the present application.

FIG. 8 shows a schematic flow chart 800 of a method for driving an organic light emitting display panel of the present application in one frame period.

Step 801: during initialization, a data line provides a data voltage signal, a reference voltage line provides a reference voltage signal, a first source voltage terminal provides a first voltage signal, a data voltage write unit transmits the data voltage signal to a gate of a driving transistor based on a signal from a first scan line, a reset detection control unit is turned on based on a signal from a second scan line, a reset unit transmits the reference voltage signal to an anode of a light emitting element based on a signal from a reset control line, and a light emission control unit transmits the first voltage signal to a first electrode of the driving transistor based on a signal from a light emission control line.

Step 802: during detection of a threshold voltage, the light emission control unit is turned off based on a signal from the light emission control line, the voltage signal on the first electrode of the driving transistor is transmitted via a first input/output terminal to a threshold voltage detection unit, and the threshold voltage detection unit implements the detection on the driving transistor based on a signal from the first detection control line.

Step 803: during writing the first voltage, the threshold voltage detection unit is turned off based on a signal from the first detection control line, the reset unit is turned off based on a signal from the reset control line, a data processing unit processes the detected voltage signal to obtain a threshold voltage, an adder unit performs compensation on the data voltage signal based on the threshold voltage, and the data voltage write unit transmits the compensated data voltage signal to the gate of the driving transistor based on a signal from the first scan line.

Step 804: during detection of a deterioration voltage, the light emission control unit is turned on based on a signal from the light emission control line, an anode voltage signal of the light emitting element is transmitted to a second terminal, and a deterioration voltage detection unit implements the detection on the light emitting element based on a signal from a second detection control line.

Step 805: during writing a second voltage, the light emission control unit is turned off based on a signal from the light emission control line, the deterioration voltage detection unit is turned off based on a signal from the second detection control line, the data processing unit processes the detected anode voltage signal to obtain a deterioration voltage, the adder unit performs compensation on the data voltage signal based on the deteriorated voltage, and the data voltage write unit transmits the compensated data voltage signal to the gate of the driving transistor based on a signal from the first scan line.

Step 806: during light emission, the data voltage write unit is turned off based on a signal from the first scan line, the reset detection control unit is turned off based on a signal from the second scan line, the light emission control unit is turned on based on a signal from the light emission control line, and the light emitting element emits light Here, when the method for driving an organic light emitting display panel according to this embodiment is used with an organic light emitting display panel (for example, the organic light emitting display panel 300 shown in FIG. 3, the organic light emitting display panel 600 shown in FIG. 6, and the organic light emitting display panel 700 shown in FIG. 7) of the present application, the timing diagram of the signals in Steps 801 to 806 is as shown in FIG. 4.

Optionally, in the driving method according to this embodiment, the reference voltage signal is not higher than the second voltage signal provided from the second source voltage terminal. As a result, light emission of the light emitting element resulting from a leakage current formed due to the fact that the voltage signal applied to the anode of the light emitting element is larger than the voltage signal applied to the cathode of the light emitting element during initialization (see Stage P1 shown in FIG. 4) can be avoided, thereby improving the display effect of an organic light emitting display panel using the driving method of this embodiment in the dark state.

Optionally, in the driving method according to this embodiment, after each row of pixel units are compensated, the light emission control unit is turned on based on a signal from the light emission control line, and the light emitting element emits light. That is, by controlling an output signal from the light emission control line, the pixels in each row of pixel units enter a light emission stage simultaneously.

As such, the threshold voltage of the driving transistor and the deterioration voltage of the light emitting element can be compensated with one row of pixel units as a unit, thereby increasing the signal processing speed.

Optionally, in the driving method according to this embodiment, after all the sub-pixels on the organic light emitting display panel are compensated, the light emission control unit is turned on based on a signal from the light emission control line, and the light emitting element emits light. That is, by controlling an output signal from the light emission control line, all the sub-pixels on the organic light emitting display panel enter a light emission stage simultaneously.

Therefore, all the sub-pixels on the organic light emitting display panel can be compensated collectively, and after all the sub-pixels are compensated, all the sub-pixels on organic light emitting display panel emit light simultaneously. In this way, visual discomforts caused by line-by-line scan, such as tailing and the like, are avoided. Particularly, when the organic light emitting display panel of the present application is applied in a VR device, the visual discomforts caused during scanning are avoided, thus avoiding the discomfort of a user such as dizziness and the like.

It should be appreciated by those skilled in the art that the scope of the present application is not limited to the technical solutions formed by specific combinations of the above-mentioned technical features, but also cover other technical solutions formed by any combinations of the above-mentioned technical features or equivalent features thereof without departing from the concept of the present invention, such as, technical solutions formed by replacing the above-mentioned features with technical features with similar functions as (but not limited to) those disclosed in the present application.

What is claimed is:

1. An organic light emitting pixel compensation circuit, comprising:

an external compensation module, wherein the external compensation module comprising a data line, a reference voltage line, a reset control line, a first detection control line, a second detection control line, a first input/output terminal, a second input/output terminal different from the first input/output terminal, a reset unit, a threshold voltage detection unit, a deterioration voltage detection unit, a data processing unit, and an adder unit, wherein:

the reset unit is connected to the reference voltage line and the second input/output terminal, and configured to transmit a signal provided from the reference voltage line to the second input/output terminal, based on a signal from the reset control line;

the threshold voltage detection unit is connected to the data line, the first input/output terminal, and the data processing unit, and configured to transmit a voltage on the first input/output terminal to the data processing unit via a first direct connection to the data processing unit, based on a signal from the first detection control line;

the deterioration voltage detection unit is connected to the second input/output terminal and the data processing unit, and configured to transmit a voltage on the second input/output terminal to the data processing unit via a second direct connection to the data processing unit, based on a signal from the second detection control line;

the data processing unit is connected to the threshold voltage detection unit, the deterioration voltage detection unit, and the adder unit, and configured to process voltages provided from the threshold voltage detection unit and the deterioration voltage detection unit, and transmit the processed voltages to the adder unit; and the adder unit is directly connected to the data processing unit and the data line, and configured to provide a compensated voltage, based on a voltage provided from the data processing unit and a voltage on the data line provided directly to the adder unit.

2. The organic light emitting pixel compensation circuit according to claim 1, further comprising a plurality of internal compensation modules, each of the internal compensation modules comprising a data voltage storage unit, a data voltage write unit, a reset detection control unit, a light emitting element, a driving transistor, a first scan line, and a second scan line, wherein:

the data voltage storage unit is connected to a gate of the driving transistor, and configured to store a gate voltage of the driving transistor;

the data voltage write unit is connected to the data line and the gate of the driving transistor, and configured to transmit a signal from the data line to the gate of the driving transistor, based on a signal from the first scan line;

the reset detection control unit is connected to an anode of the light emitting element and the second input/output terminal, and configured to transmit an anode voltage of the light emitting element to the second input/output terminal or transmit the voltage of the second input/output terminal to the anode of the light emitting element, based on a signal from the second scan line;

a cathode of the light emitting element is connected to a second source voltage terminal; and a second electrode of the driving transistor is connected to the anode of the light emitting element, and a first electrode of the driving transistor is connected to the first input/output terminal.

3. The organic light emitting pixel compensation circuit according to claim 2, wherein each of the plurality of internal compensation modules further comprise a light emission control line and a light emission control unit, wherein the light emission control unit is connected to a first source voltage terminal and the first electrode of the driving transistor, and configured to control light emission of the light emitting element, based on a signal from the light emission control line.

4. The organic light emitting pixel compensation circuit according to claim 3, wherein the light emission control unit comprises a sixth switch transistor, wherein a gate of the sixth switch transistor is connected to the light emission control line, a first electrode of the sixth switch transistor is connected to the first source voltage terminal, and a second electrode of the sixth switch transistor is connected to the first electrode of the driving transistor.

5. The organic light emitting pixel compensation circuit according to claim 2, wherein the external compensation module further comprises a light emission control line and a light emission control unit, wherein the light emission control unit is connected to a first source voltage terminal and the first input/output terminal, and configured to transmit a voltage of the first source voltage terminal to the first input/output terminal, based on a signal from the light emission control line.

6. The organic light emitting pixel compensation circuit according to claim 5, wherein the light emission control unit comprises a sixth switch transistor, wherein a gate of the sixth switch transistor is connected to the light emission control line, a first electrode of the sixth switch transistor is connected to the first source voltage terminal, and a second electrode of the sixth switch transistor is connected to the first input/output terminal.

7. The organic light emitting pixel compensation circuit according to claim 2, wherein the reset detection control unit comprises a third switch transistor, wherein a gate of the third switch transistor is connected to the second scan line, a first electrode of the third switch transistor is connected to the second input/output terminal, and a second electrode of the third switch transistor is connected to the anode of the light emitting element.

8. The organic light emitting pixel compensation circuit according to claim 2, further comprising a common voltage line, wherein the data voltage storage unit comprises a third capacitor, and the data voltage write unit comprises a fifth switch transistor, wherein a first terminal of the third capacitor is connected to the gate of the driving transistor, a second terminal of the third capacitor is connected to the common voltage line, a gate of the fifth switch transistor is connected to the first scan line, a first electrode of the fifth switch transistor is connected to the data line, and a second electrode of the fifth switch transistor is connected to the gate of the driving transistor.

9. The organic light emitting pixel compensation circuit according to claim 1, wherein the threshold voltage detection unit comprises a first switch transistor and a first capacitor, wherein a gate of the first switch transistor is connected to the first detection control line, a first electrode of the first switch transistor is connected to the first input/output terminal, a second terminal of the first capacitor is grounded, and a second electrode of the first switch transistor and a first terminal of the first capacitor are connected to the data processing unit.

10. The organic light emitting pixel compensation circuit according to claim 1, wherein the deterioration voltage detection unit comprises a second switch transistor and a second capacitor, wherein a gate of the second switch transistor is connected to the second detection control line, a first electrode of the second switch transistor and a first terminal of the second capacitor are connected to the second input/output terminal, a second terminal of the second capacitor is grounded, and a second electrode of the second switch transistor is connected to the data processing unit.

11. The organic light emitting pixel compensation circuit according to claim 1, wherein the reset unit comprises a fourth switch transistor, wherein a gate of the fourth switch transistor is connected to the reset control line, a first electrode of the fourth switch transistor is connected to the reference voltage line, and a second electrode of the fourth switch transistor is connected to the second input/output terminal.

12. The organic light emitting pixel compensation circuit according to claim 1, further comprising a threshold voltage storage unit and a deterioration voltage storage unit connected to the data processing unit.

13. The organic light emitting pixel compensation circuit according to claim 1, further comprising a driving chip, wherein the driving chip is provided with a look up table memory configured to store current-voltage characteristic parameters of the light emitting element.

14. An organic light emitting display panel, comprising a display region and a non-display region surrounding the display region, wherein a plurality of external compensation modules are arranged in the non-display region, each of the external compensation modules comprises a data line, a reference voltage line, a reset control line, a first detection control line, a second detection control line, a first input/output terminal, a second input/output terminal different from the first input/output terminal, a reset unit, a threshold voltage detection unit, a deterioration voltage detection unit, a data processing unit, and an adder unit, wherein:

the reset unit is connected to the reference voltage line and the second input/output terminal, and configured to transmit a signal provided from the reference voltage line to the second input/output terminal, based on a signal from the reset control line;

the threshold voltage detection unit is connected to the data line, the first input/output terminal, and the data processing unit, and configured to transmit a voltage on the first input/output terminal to the data processing unit via a first direct connection to the data processing unit, based on a signal from the first detection control line;

the deterioration voltage detection unit is connected to the second input/output terminal and the data processing unit, and configured to transmit a voltage on the second input/output terminal to the data processing unit via a second direct connection to the data processing unit, based on a signal from the second detection control line;

the data processing unit is connected to the threshold voltage detection unit, the deterioration voltage detection unit, and the adder unit, and configured to process voltages provided from the threshold voltage detection unit and the deterioration voltage detection unit, and transmit the processed voltages to the adder unit; and the adder unit is directly connected to the data processing unit and the data line, and configured to provide a compensated voltage, based on a voltage provided from the data processing unit and a voltage on the data line provided directly to the adder unit.

15. The organic light emitting display panel according to claim 14, wherein the display region comprises a plurality of rows of pixel units and a plurality of columns of pixel units, each row of the pixel units comprise a plurality of sub-pixels, and each column of the pixel units comprise a plurality of sub-pixels; and each of the sub-pixels is provided with an internal compensation module comprising a data voltage storage unit, a data voltage write unit, a reset detection control unit, a light emitting element, a driving transistor, a first scan line, and a second scan line, wherein:

the data voltage storage unit is connected to a gate of the driving transistor, and configured to store a gate voltage of the driving transistor;

the data voltage write unit is connected to the data line and the gate of the driving transistor, and configured to transmit a signal from the data line to the gate of the driving transistor, based on a signal from the first scan line;

the reset detection control unit is connected to an anode of the light emitting element and the second input/output terminal, and configured to transmit an anode voltage of the light emitting element to the second input/output terminal or transmit a voltage of the second input/output terminal to the anode of the light emitting element, based on a signal from the second scan line;

a cathode of the light emitting element is connected to a second source voltage terminal; and a second electrode of the driving transistor is connected to the anode of the light emitting element, and a first electrode of the driving transistor is connected to the first input/output terminal.

16. The organic light emitting display panel according to claim 15, wherein the internal compensation module further comprises a light emission control line and a light emission control unit, wherein the light emission control unit is connected to a first source voltage terminal and the first electrode of the driving transistor, and configured to control light emission of the light emitting element, based on a signal from the light emission control line.

17. A method for driving the organic light emitting display panel according to claim 16, comprising:

during initialization, providing a data voltage by the data line, providing a reference voltage by the reference voltage line, providing a first voltage by the first source voltage terminal, transmitting the data voltage to the gate of the driving transistor by the data voltage write unit based on a signal from the first scan line, turning on the reset detection control unit based on a signal from the second scan line, transmitting the reference voltage to the anode of the light emitting element by the reset unit based on a signal from the reset control line, and transmitting the first voltage to the first electrode of the driving transistor by the light emission control unit based on a signal from the light emission control line;

during detection of a threshold voltage, turning off the light emission control unit based on a signal from the light emission control line, transmitting a voltage on the first electrode of the driving transistor to the threshold voltage detection unit via the first input/output terminal, and implementing detection on the driving transistor by the threshold voltage detection unit based on a signal from the first detection control line;

during writing the first voltage, turning off the threshold voltage detection unit based on a signal from the first detection control line, turning off the reset unit based on a signal from the reset control line, processing the detected voltage by the data processing unit to obtain a threshold voltage, compensating the data voltage by the adder unit based on the threshold voltage, and transmitting the compensated data voltage to the gate of the driving transistor by the data voltage write unit based on a signal from the first scan line;

during detection of a deterioration voltage, turning on the light emission control unit based on a signal from the light emission control line, transmitting the anode voltage of the light emitting element to the second input/output terminal, and implementing detection on the light emitting element by the deterioration voltage detection unit based on a signal from the second detection control line;

during writing a second voltage, turning off the light emission control unit based on a signal from the light emission control line, turning off the deterioration voltage detection unit based on a signal from the second detection control line, processing the detected anode voltage by the data processing unit to obtain a deterioration voltage, compensating the data voltage by the adder unit based on the deterioration voltage, and transmitting the compensated data voltage to the gate of the driving transistor by the data voltage write unit based on a signal from the first scan line; and during light emission, turning off the data voltage write unit based on a signal from the first scan line, turning off the reset detection control unit based on a signal from the second scan line, turning on the light emission control unit based on a signal from the light emission control line, and emitting light by the light emitting element.

18. The method according to claim 17, wherein the reference voltage is not higher than the second voltage provided from the second source voltage terminal.

19. The method according to claim 17, wherein after each row of the pixel units are compensated, the light emission control unit is turned on based on a signal from the light emission control line, and the light emitting element emits light.

20. The method according to claim 17, wherein after each of the pixel units of the organic display panel is compensated, the light emission control unit is turned on based on a signal from the light emission control line, and the light emitting element emits light.

21. The organic light emitting display panel according to claim 15, wherein each of the plurality of external compensation modules further comprise a light emission control line and a light emission control unit, wherein the light emission control unit is connected to a first source voltage terminal and the first input/output terminal, and configured to transmit a voltage of the first source voltage terminal to the first input/output terminal, based on a signal from the light emission control line.

22. The organic light emitting display panel according to claim 15, wherein each column of the pixel units are connected with one of the external compensation modules.

23. The organic light emitting display panel according to claim 22, wherein at least two adjacent columns of the pixel units are connected to a same reference voltage line.

24. The organic light emitting display panel according to claim 15, wherein each row of the pixel units are connected with one first scan line and one second scan line.

25. The organic light emitting display panel according to claim 24, wherein the first scan line and the second scan line connected to the same row of the pixel units share a common scan line.

26. The organic light emitting display panel according to claim 15, further comprising a driving chip, wherein the driving chip is provided with a look up table memory configured to store current-voltage characteristic parameters of the light emitting element.

27. The organic light emitting display panel according to claim 26, wherein each of the pixel units of the organic light emitting display panel is pre-compensated, and the current-voltage characteristic parameters of each of the light emitting elements are stored in the look up table memory.

* * * * *